US008796910B2

(12) United States Patent
Jung et al.

(10) Patent No.: US 8,796,910 B2
(45) Date of Patent: Aug. 5, 2014

(54) HALOGEN LAMP COMPRISING BULB AND STRUCTURE TO PREVENT FILAMENT PARTS FROM CONTRACTING EACH OTHER

(75) Inventors: Jae kwan Jung, Changwon (KR); Sungho Choi, Changwon (KR); Jaeho Cho, Changwon (KR)

(73) Assignee: LG Electronics, Inc., Seoul (KR)

( * ) Notice: Subject to any disclaimer, the term of this patent is extended or adjusted under 35 U.S.C. 154(b) by 0 days.

(21) Appl. No.: 12/920,926

(22) PCT Filed: Jul. 23, 2009

(86) PCT No.: PCT/KR2009/004115

§ 371 (c)(1),
(2), (4) Date: Sep. 3, 2010

(87) PCT Pub. No.: WO2010/011097

PCT Pub. Date: Jan. 28, 2010

(65) Prior Publication Data

US 2011/0012501 A1 Jan. 20, 2011

(30) Foreign Application Priority Data

Jul. 23, 2008 (KR) ..... 10-2008-0071431
Jul. 24, 2008 (KR) ..... 10-2008-0072018
Jul. 24, 2008 (KR) ..... 10-2008-0072019
Jul. 24, 2008 (KR) ..... 10-2008-0072020

(51) Int. Cl.
*H01J 1/96* (2006.01)

(52) U.S. Cl.
USPC ..... 313/274

(58) Field of Classification Search
USPC ..... 313/274
See application file for complete search history.

(56) References Cited

U.S. PATENT DOCUMENTS 3,875,443 A * 4/1975 Nakamura ..... 313/274
5,146,134 A * 9/1992 Stadler et al. ..... 313/579
5,686,794 A * 11/1997 Streppel et al. ..... 313/579
5,821,678 A * 10/1998 Michel ..... 313/274
7,705,539 B2 * 4/2010 Wen ..... 313/634

FOREIGN PATENT DOCUMENTS

EP 1 973 144 A1 9/2008
EP 2 081 215 A1 7/2009
JP 2003-077423 A 3/2003
JP 2005-183267 A 7/2005
JP 2006-080096 A 3/2006
KR 10-0156003 B1 11/1998
KR 10-2006-0116250 A 11/2006
WO WO 2007/079629 A1 7/2007

OTHER PUBLICATIONS

Korean Office Action dated Feb. 12, 2010 issued in Application No. 10-2008-0071431.

(Continued)

*Primary Examiner* — Nimeshkumar Patel
*Assistant Examiner* — Jacob R Stern
(74) *Attorney, Agent, or Firm* — Ked & Associates LLP

(57) ABSTRACT

Embodiments provide a halogen lamp configured to minimize a short circuit of a filament.
Provided is a halogen lamp that includes a support part passing through a bulb and disposed in the bulb. A filament is hung on the support part. Thus, a short circuit of the filament is minimized.

20 Claims, 6 Drawing Sheets

(56) References Cited

OTHER PUBLICATIONS

Korean Office Action dated Feb. 12, 2010 issued in Application No. 10-2008-0072018.

PCT International Search Report dated Mar. 10, 2010 issued in Application No. PCT/KR2009/004115.

European Search Report dated Aug. 23, 2011 issued in Application No. 09 80 0578.

* cited by examiner

HALOGEN LAMP COMPRISING BULB AND STRUCTURE TO PREVENT FILAMENT PARTS FROM CONTRACTING EACH OTHER

TECHNICAL FIELD

The present disclosure relates to a halogen lamp, and more particularly, to a halogen lamp configured to minimize damage.

BACKGROUND ART

Halogen lamps are used as illuminating sources or heating sources, which emit light or heat by using electric resistance of a filament enclosed in a bulb filled with halogen gas, so as to illuminate or heat an object. In this case, both ends of the filament are fixed to a sealing part of the bulb.

DISCLOSURE

Technical Problem

However, such a halogen lamp is susceptible to a short circuit due to a contact of portions of a filament. Specifically, when external force is applied to a halogen lamp, the probability of a short circuit for a filament increases as described above.

Technical Solution

In one embodiment, a lamp includes: a bulb; a filament enclosed in the bulb; and a support part in the bulb, the support part having both ends fixed to the bulb, the filament being hung on the support part.

In another embodiment, a lamp includes: a bulb including a sealing part provided to an end; a filament enclosed in the bulb and having both ends fixed to the sealing part; a support part on which the filament is hung; and a contact prevention part between the support part and both the ends of the filament, the contact prevention part preventing a contact of the filament.

In further another embodiment, a lamp includes: a bulb including a sealing part provided to an end and having an inner space in a closed curve, both ends of which are connected to the sealing part; and a filament enclosed in the inner space of the bulb along the inner space of the bulb and having both ends fixed to the sealing part.

Advantageous Effects

Embodiments provide a halogen lamp configured to minimize a short circuit of a filament.

BEST MODE

Hereinafter, a halogen lamp according to a first embodiment will now be described with reference to the accompanying drawings.

Figure 1:
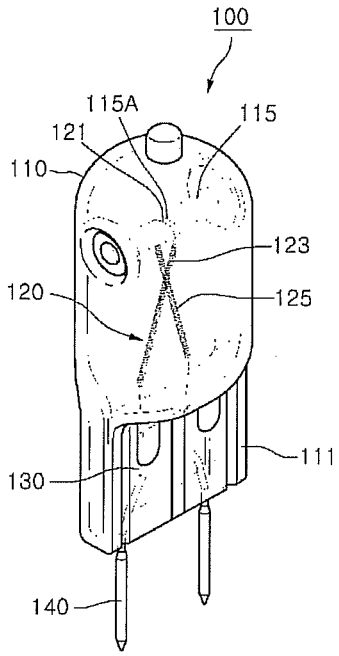
FIG. 1 is a perspective view illustrating a halogen lamp according to the first embodiment.
Figure 2:
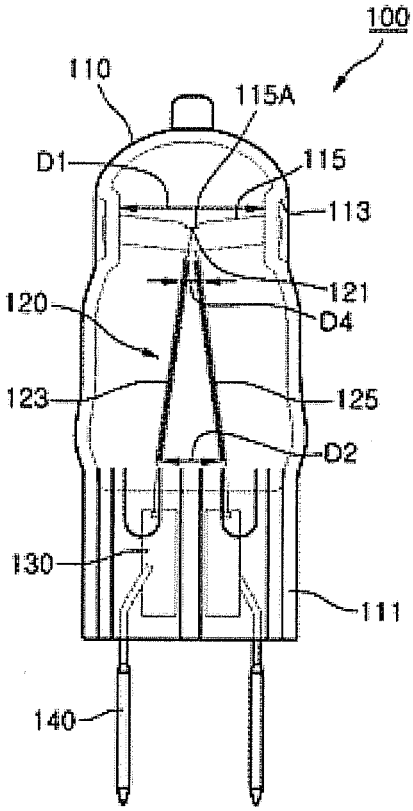
FIG. 2 is a front view illustrating the halogen lamp according to the first embodiment.
Figure 3:
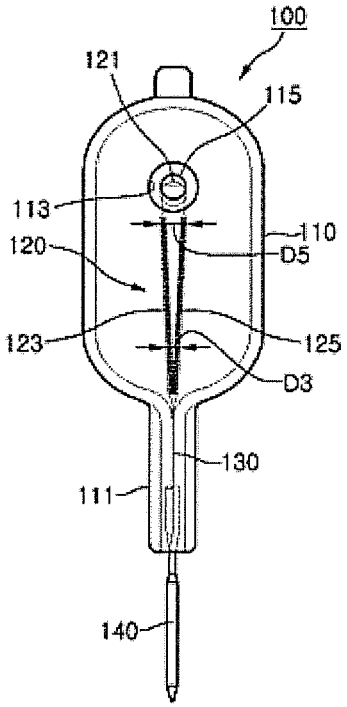
FIG. 3 is a side view illustrating the halogen lamp according to the first embodiment.

FIG. 1 is a perspective view illustrating a halogen lamp according to the first embodiment. FIG. 2 is a front view illustrating the halogen lamp according to the current embodiment. FIG. 3 is a side view illustrating the halogen lamp according to the current embodiment.

Referring to FIGS. 1 to 3, a halogen lamp 100 emits light or heat to heat an external illumination or an external heat target object. The halogen lamp 100 includes a bulb 110 and a filament 120. The filament 120 is disposed in the bulb 110 that is filled with halogen gas.

The bulb 110 is formed of a transparent or translucent material. For example, the bulb 110 may be formed of glass. An end of the bulb 110 is provided with a sealing part 111. The sealing part 111 may be formed by compressing a portion of the bulb 110 flat. The sealing part 111 substantially maintains the inside of the bulb 110 in a vacuum state.

The outer surface of the bulb 110 is provided with a pair of through holes 113 at positions facing each other. A support part 115 to be described later passes through the through holes 113. In the current embodiment, the through holes 113 are disposed in the outer surface of the bulb 110 and spaced a predetermined distance from the sealing part 111.

The support part 115 is disposed in the bulb 110. The filament 120 is hung on the support part 115. The support part 115 passes through the through holes 113. In more detail, when the support part 115 passes through the through holes 113, the both ends of the support part 115 are fixed to the bulb 110 at the inner peripheries of the through holes 113. In addition, substantially, the support part 115 may be formed of the same material as that of the bulb 110. Thus, when the bulb 110 is formed of glass, the support part 115 may be formed of glass.

The middle portion of the support part 115 has an approximately V or U shape that is inclined toward the sealing part 111. In addition, the middle portion of the support part 115 is provided with a support recess 115A. The support recess 115A is formed substantially by partially cutting the outer surface of the support part 115. The support part 115 is not limited to a V or U shape. However, when the support part 115 has a V or U shape, the filament 120 is more easily placed on the support recess 115A, and is prevented from being removed from the support recess 115A.

The filament 120 emits light or heat by electric resistance by a power source applied from the outside. The both ends of the filament 120 hung on the support part 115 are fixed to the sealing part 111. In the current embodiment, the filament 120 has an approximately U shape, and when a middle part 121 of the filament 120 is hung on the support part 115, more particularly, on the support recess 115A, both ends of the filament 120 are fixed to the sealing part 111. Hereinafter, in the views from FIGS. 1 and 2, a range from the middle part 121 of the filament 120 to the left end of the filament 120 is referred to as a first end 123, and a range from the middle part 121 of the filament 120 to the right end of the filament 120 is referred to as a second end 125, for convenience in description.

Both ends of the filament 120 fixed to the sealing part 111 are disposed on the same plane. The support part 115 is disposed on an imaginary plane on which both ends of the filament 120 are disposed. The support part 115 may be parallel to the imaginary plane on which both ends of the filament 120 are disposed. However, since the support part 115 has a predetermined diameter, the first and second ends 123 and 125 of the filament 120 are substantially disposed respectively on different planes crossing each other. In other words, the filament 120 hung on the support part 115 is twisted.

Two metal fragments 130 are embedded in the sealing part 111. The metal fragments 130 are spaced a predetermined distance from each other in the sealing part 111 on the left and right sides, respectively. The upper ends of the metal fragments 130 are connected respectively with both ends of the filament 120 fixed to the sealing part 111.

Lead rods 140 are connected to the lower ends of the metal fragments 130, respectively. An end of the lead rod 140 is fixed to the sealing part 111, and the other end extends out of the sealing part 111. For example, a lead wire for supplying power may be connected to the lead rod 140.

Hereinafter, an operation according to the first embodiment will now be described in detail.

First, when power is applied to the halogen lamp 100, the power is transmitted through the lead rods 140 and the metal fragments 130 to the filament 120. The filament 120 emits light and heat by its electric resistance, so as to illuminate the outside or heat an object.

In the current embodiment, both ends of the filament 120 hung on the support part 115 are fixed to the sealing part 111. In other words, when both ends of the filament 120 are fixed to the sealing part 111, the middle portion of the filament 120 is supported by the support part 115, so that the filament 120 is supported at totally three points.

Thus, even when external force is applied to the halogen lamp 100, displacements of the filament 120 supported at the three points are reduced. Accordingly, a short circuit of the filament 120, that is, the possibility of a short circuit due to a contact of the first and second ends 123 and 125 is relatively reduced.

The middle part of the filament 120 is placed substantially in the support recess 115A of the support part 115. Thus, the filament 120 hung on the support part 115 is prevented from arbitrarily moving along the longitudinal direction of the support part 115, thereby minimizing a contact of the filament 120.

As shown in FIGS. 1-3, the lamp 100 according to this embodiment includes the bulb 110, which has an enclosed space with a sealed base at a bottom of the bulb with connectors or lead rods 140 provided thereon for connection to an external power source; a support bar or part 115 that extends in a first direction a first prescribed distance D1 across the enclosed space; and a filament 120 having a prescribed length. A portion of the filament 120 wraps around an outer surface of the support bar 115, and includes a first filament part or first end 123 and a second filament part or second end 125, ends of the first and second filament parts 123, 125 being electrically coupled to the connectors 140 near the bottom of the bulb 110. The first and second filament parts 123, 125 are spaced apart from each other in a direction parallel to the first direction of the support bar 115, and the first and second filament parts 123, 125 are spaced apart from each other in a second direction perpendicular to the first direction. The first and second filament parts 123, 125 define a second prescribed distance D2 near the connectors 140 in the first direction and a third prescribed distance D3 near the connectors 140 in the second direction. The second prescribed distance D2 is less than the first prescribed distance D1, and is larger than the third prescribed distance D3, and a diameter of the support bar 115 is less than the second prescribed distance D2 and is larger than the third prescribed distance D3. The first and second filament parts 123, 125 further define a fourth prescribed distance D4 near the support bar 115 in the first direction and a fifth prescribed distance D5 near the support bar 115 in the second direction, and the second prescribed distance D2 is larger than the fourth prescribed distance D4, and the fifth prescribed distance D5 is larger than the third prescribed distance D3.

MODE FOR INVENTION

Hereinafter, a halogen lamp according to a second embodiment will now be described with reference to the accompanying drawings.

Figure 4:
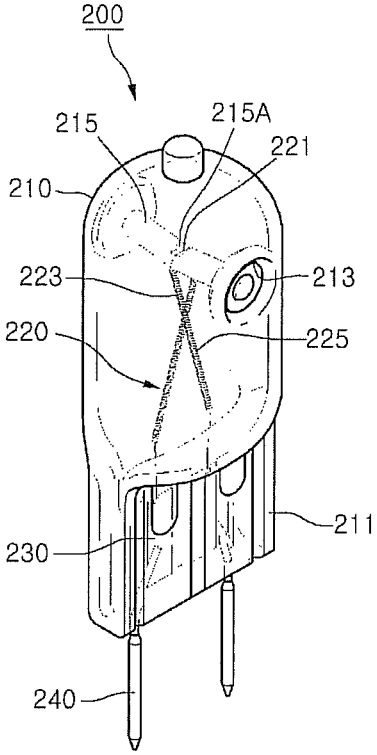
FIG. 4 is a perspective view illustrating a halogen lamp according to a second embodiment.

FIG. 4 is a perspective view illustrating a halogen lamp according to the second embodiment. In the current embodiment, descriptions of the same components as those of the first embodiment will be omitted.

Referring to FIG. 4, in a halogen lamp 200 according to the second embodiment, an end of a bulb 210 is provided with a sealing part 211, and the bulb 210 is provided with through holes 213. A support part 215 passing through the through holes 213 is disposed in the bulb 210. The support part 215 is provided with a support recess 215A. A filament 220 is disposed in the bulb 210. When the filament 220 is hung on the support part 215, and particularly, when the middle part of the filament 220 is placed in the support recess 215A, both ends of the filament 220 are fixed to the sealing part 211.

However, in the current embodiment, an imaginary plane on which both ends of the filament 220 fixed to the sealing part 211 are disposed is perpendicular to the support part 215. Thus, when the filament 220 is hung on the support part 215, a first end 223 that ranges from the middle part of the filament 220 illustrated in FIG. 3 to the left end of FIG. 3, and a second end 225 that ranges from the middle part of the filament 220 to the right end are disposed on an identical plane. Also in the current embodiment, the movement of the filament 220 due to external force is minimized as described in the previous embodiment, so that a contact of the first and second ends 223 and 225 is minimized. Thus, a short circuit of the filament 220 can be minimized.

Other components according to the second embodiment, that is, metal fragments 230 and lead rods 240 are the same as those of the first embodiment. Hereinafter, a halogen lamp according to a third embodiment will now be described with reference to the accompanying drawing.

Figure 5:
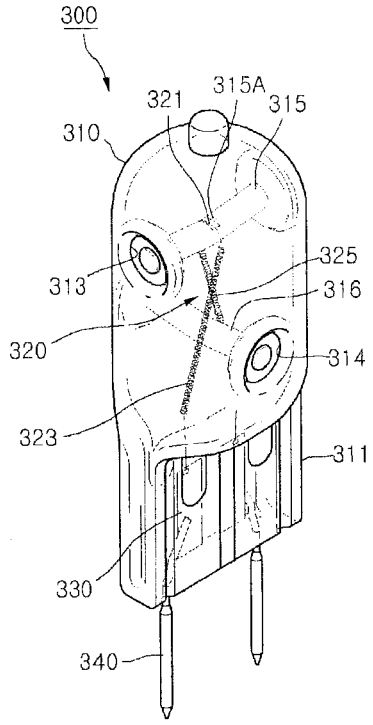
FIG. 5 is a perspective view illustrating a halogen lamp according to a third embodiment.

FIG. 5 is a perspective view illustrating a halogen lamp according to the third embodiment. In the current embodiment, descriptions of the same components as those of the first embodiment will be omitted.

Referring to FIG. 5, in a halogen lamp 300 according to the third embodiment, an end of a bulb 310 is provided with a sealing part 311, and the bulb 310 is provided with first and second through holes 313 and 314. The first through holes 313 are disposed in the outer surface of the bulb 310, and spaced a predetermined distance from the sealing part 311, and the second through holes 314 are disposed in the outer surface of the bulb 310 between the sealing part 311 and the first through holes 313.

In the current embodiment, an imaginary line connecting the first through holes 313 perpendicularly crosses an imaginary line connecting the second through holes 314. However, the imaginary line connecting the first through holes 313 may cross an imaginary line connecting the second through holes 314 at a predetermined angle. A support part 315 is disposed in the bulb 310. The support part 315 passes through the first through holes 313 provided to the bulb 310. The support part 315 is provided with a support recess 315A.

A contact prevention part 316 is disposed in the bulb 310 to prevent a contact a filament 320. When the contact prevention part 316 passes through the second through holes 314, both ends of the contact prevention part 316 are fixed to the bulb 310 at regions adjacent to the inner peripheries of the second through holes 314. Like the support part 315, the contact prevention part 316 may be formed of the same material as that of the bulb 310, that is, of glass.

As described above, the imaginary line connecting the first through holes 313 perpendicularly crosses the imaginary line connecting the second through holes 314. Thus, the support part 315 and the contact prevention part 316 perpendicularly cross each other.

The filament 320 is disposed in the bulb 310. Both ends of the filament 320 hung on the support part 315 are fixed to the sealing part 311. With respect to the support part 315, the filament 320 is substantially divided by the contact prevention part 316. In the current embodiment, the filament 320 has an approximately U shape, and when a middle part 321 of the filament 320 is hung on the support part 315, more particularly, on the support recess 315A, both ends of the filament 320 are fixed to the sealing part 311. Hereinafter, in the view from FIG. 5, a range from the middle part 321 of the filament 320 to the left end of the filament 320 is referred to as a first end 323, and a range from the middle part 321 of the filament 320 to the right end of the filament 320 is referred to as a second end 325, for convenience in description.

Both ends of the filament 320 fixed to the sealing part 311 are disposed on the same plane. The support part 315 is disposed on an imaginary plane on which both ends of the filament 320 are disposed. The support part 315 may be parallel to the imaginary plane on which both ends of the filament 320 are disposed. Since the contact prevention part 316 perpendicularly crosses the support part 315, the contact prevention part 316 is perpendicular to the imaginary plane on which both ends of the filament 320 are disposed. Thus, the first and second ends 323 and 325 are disposed in the bulb 310 on both sides of the contact prevention part 316. That is, the contact prevention part 316 substantially separates the first and second ends 323 and 325 to prevent a contact between the first and second ends 323 and 325. In the current embodiment, the first and second ends 323 and 325 each contacts the outer surface of the contact prevention part 316, but the present disclosure is not limited thereto. That is, the first and second ends 323 and 325 may be spaced apart from the contact prevention part 316 according to the diameter of the contact prevention part 316.

Also in the current embodiment, the movement of the filament 320 due to external force is minimized as described in the previous embodiment, so that a contact of the first and second ends 323 and 325 is minimized. Thus, a short circuit of the filament 320 can be minimized.

Other components according to the second embodiment, that is, metal fragments 330 and lead rods 340 are the same as those of the first embodiment. Hereinafter, a halogen lamp according to a fourth embodiment will now be described with reference to the accompanying drawing.

Figure 6:
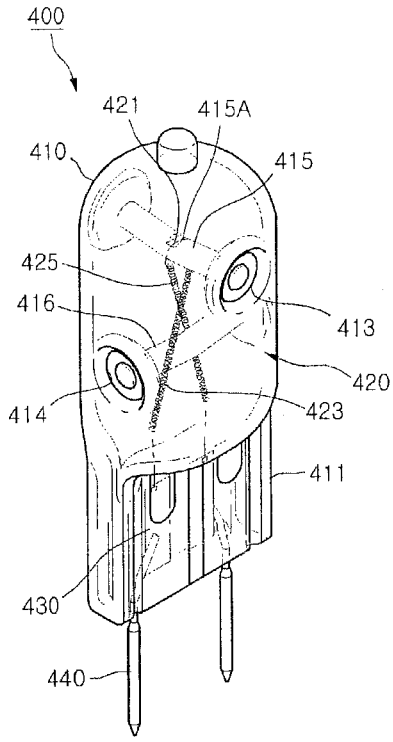
FIG. 6 is a perspective view illustrating a halogen lamp according to a fourth embodiment.

FIG. 6 is a perspective view illustrating a halogen lamp according to the fourth embodiment. In the current embodiment, descriptions of the same components as those of the third embodiment will be omitted.

Referring to FIG. 6, in a halogen lamp 400 according to the fourth embodiment, an end of a bulb 410 is provided with a sealing part 411, and a support part 415 is disposed in the bulb 410. The support part 415 is provided with a support recess 415A. The support part 415 passes through first through holes 413 provided to the bulb 410. A contact prevention part 416 is disposed in the bulb 410. The contact prevention part 416 passes through second through holes 414 provided to the bulb 410.

A filament 420 is disposed in the bulb 410. When the filament 420 is hung on the support part 415, and particularly, when the middle part of the filament 420 is placed in the support recess 415A, both ends of the filament 420 are fixed to the sealing part 411.

In the current embodiment, both ends of the filament 420 fixed to the sealing part 411 are disposed on the same imaginary plane. The support part 415 is perpendicular to an imaginary plane on which both ends of the filament 420 are disposed. The contact prevention part 416 perpendicularly crosses the support part 415, that is, is parallel to the imaginary plane on which both ends of the filament 420 are disposed.

Also in the current embodiment, the movement of the filament 420 due to external force is minimized as described in the previous embodiment, so that a contact of the first and second ends 423 and 425 is minimized. Thus, a short circuit of the filament 420 can be minimized. In addition, the contact prevention part 416 separates the first and second ends 423 and 425 to prevent a contact between the first and second ends 423 and 425, thereby preventing a short circuit of the filament 420.

Other components according to the second embodiment, that is, metal fragments 430 and lead rods 440 are the same as those of the third embodiment. Hereinafter, a halogen lamp according to a fifth embodiment will now be described with reference to the accompanying drawing.

Figure 7:
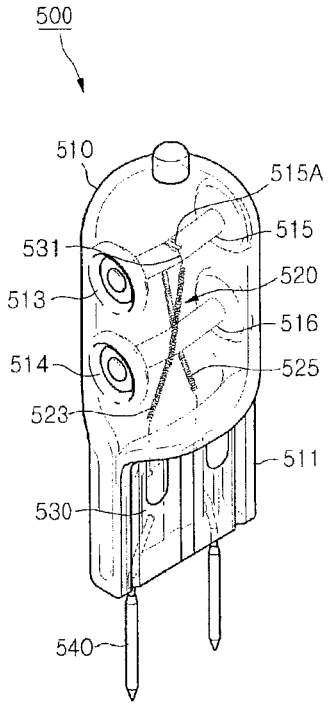
FIG. 7 is a perspective view illustrating a halogen lamp according to a fifth embodiment.

FIG. 7 is a perspective view illustrating a halogen lamp according to the fifth embodiment. In the current embodiment, descriptions of the same components as those of the third embodiment will be omitted.

Referring to FIG. 7, in a halogen lamp 500 according to the fifth embodiment, an end of a bulb 510 is provided with a sealing part 511, and a support part 515 is disposed in the bulb 510. The support part 515 is provided with a support recess 515A. The support part 515 passes through first through holes 513 provided to the bulb 510. A contact prevention part 516 is disposed in the bulb 510. The contact prevention part 516 passes through second through holes 514 provided to the bulb 510.

A filament 520 is disposed in the bulb 510. When the filament 520 is hung on the support part 515, and particularly, when the middle part of the filament 520 is placed in the support recess 515A, both ends of the filament 520 are fixed to the sealing part 511.

In the current embodiment, both ends of the filament 520 fixed to the sealing part 511 are disposed on the same imaginary plane. The support part 515 and the contact prevention part 516 are disposed on the imaginary plane on which both ends of the filament 520 are disposed, or are parallel to the imaginary plane. Thus, also in the current embodiment, the movement of the filament 520 due to external force is minimized as described in the previous embodiment, so that a contact of the first and second ends 523 and 525 is minimized. Thus, a short circuit of the filament 520 can be minimized. In addition, the contact prevention part 516 separates the first and second ends 523 and 525 to prevent a contact between the first and second ends 523 and 525, thereby preventing a short circuit of the filament 520.

Other components according to the second embodiment, that is, metal fragments 530 and lead rods 540 are the same as those of the third embodiment. Hereinafter, a halogen lamp according to a sixth embodiment will now be described with reference to the accompanying drawing.

Figure 8:
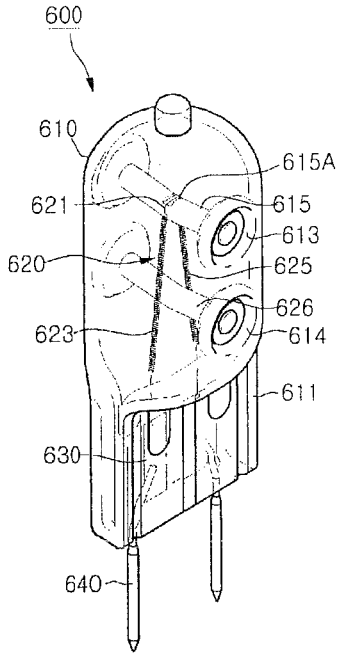
FIG. 8 is a perspective view illustrating a halogen lamp according to a sixth embodiment.

FIG. 8 is a perspective view illustrating a halogen lamp according to the sixth embodiment. In the current embodiment, descriptions of the same components as those of the third embodiment will be omitted.

Referring to FIG. 8, in a halogen lamp 600 according to the sixth embodiment, an end of a bulb 610 is provided with a sealing part 611, and a support part 615 is disposed in the bulb 610. The support part 615 is provided with a support recess 615A. The support part 615 passes through first through holes 613 provided to the bulb 610. A contact prevention part 616 is disposed in the bulb 610. The contact prevention part 616 passes through second through holes 614 provided to the bulb 610.

A filament 620 is disposed in the bulb 610. When the filament 620 is hung on the support part 615, and particularly, when the middle part of the filament 620 is placed in the support recess 615A, both ends of the filament 620 are fixed to the sealing part 611.

In the current embodiment, both ends of the filament 620 fixed to the sealing part 611 are disposed on the same imaginary plane. The support part 615 and the contact prevention part 616 are parallel to each other, and cross the imaginary plane on which both ends of the filament 620 are disposed.

Thus, also in the current embodiment, the movement of the filament 620 due to external force is minimized as described in the previous embodiment, so that a contact of the first and second ends 623 and 625 is minimized. Thus, a short circuit of the filament 620 can be minimized. In addition, the contact prevention part 616 separates the first and second ends 623 and 625 to prevent a contact between the first and second ends 623 and 625, thereby preventing a short circuit of the filament 620.

Other components according to the second embodiment, that is, metal fragments 630 and lead rods 640 are the same as those of the third embodiment. Hereinafter, a halogen lamp according to a seventh embodiment will now be described with reference to the accompanying drawings.

Figure 9:
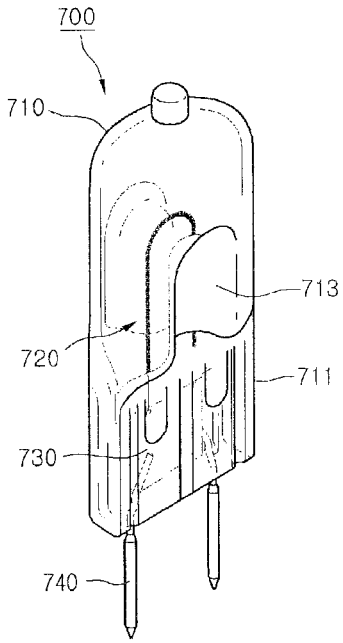
FIG. 9 is a perspective view illustrating a halogen lamp according to a seventh embodiment.
Figure 10:
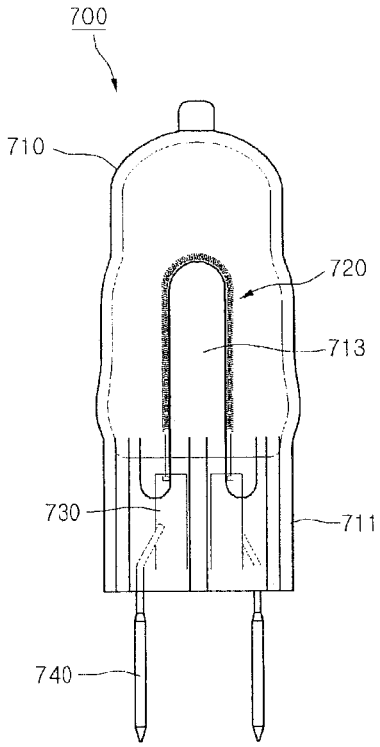
FIG. 10 is a front view illustrating the halogen lamp according to the seventh embodiment.
Figure 11:
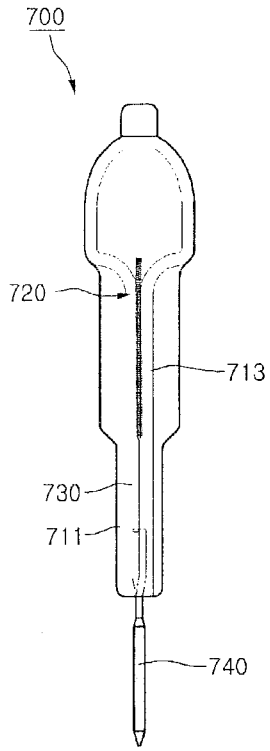
FIG. 11 is a side view illustrating the halogen lamp according to the seventh embodiment.

FIG. 9 is a perspective view illustrating a halogen lamp according to the seventh embodiment. FIG. 10 is a front view illustrating the halogen lamp according to the current embodiment. FIG. 11 is a side view illustrating the halogen lamp according to the current embodiment.

Referring to FIGS. 9 to 11, a halogen lamp 700 emits light or heat to heat an external illumination or an external heat target object. The halogen lamp 700 includes a bulb 710 and a filament 720. The filament 720 is disposed in the bulb 710 that is filled with halogen gas.

The bulb 710 is formed of a transparent or translucent material. For example, the bulb 710 may be formed of glass. An end of the bulb 710 is provided with a sealing part 711. The sealing part 711 may be formed by compressing a portion of the bulb 710 flat. The sealing part 711 substantially maintains the inside of the bulb 710 in a vacuum state.

The bulb 710 is provided with a partition part 713 that prevents a contact of the filament 720. The partition part 713 is formed using a portion of the bulb 710. Substantially, outer surfaces of the bulb 710 facing each other are compressed to form the partition part 713. In the current embodiment, a portion of the bulb 710 is compressed to form the partition part 713 to be connected to the sealing part 711. Due to the partition part 713, an inner space of the bulb 710 substantially has a U-shaped closed curve.

The filament 720 emits light or heat by electric resistance by a power source applied from the outside. The both ends of the filament 720 fixed to the sealing part 711 are disposed in the bulb 710. The filament 720 is disposed along the U-shaped inner space of the bulb 710. Thus, the filament 720 has a U shape to correspond to the inner space of the bulb 710.

Two metal fragments 730 are embedded in the sealing part 711. The metal fragments 730 are spaced a predetermined distance from each other in the sealing part 711 on the left and right sides, respectively. The upper ends of the metal fragments 730 are connected respectively with both ends of the filament 720 fixed to the sealing part 711.

Lead rods 740 are connected to the lower ends of the metal fragments 730, respectively. An end of the lead rod 740 is fixed to the sealing part 711, and the other end extends out of the sealing part 711. For example, a lead wire for supplying power may be connected to the lead rod 740.

Hereinafter, an operation according to the seventh embodiment will now be described in detail.

First, when power is applied to the halogen lamp 700, the power is transmitted through the lead rods 740 and the metal fragments 730 to the filament 720. The filament 720 emits light and heat by its electric resistance, so as to illuminate the outside or heat an object.

In the current embodiment, the filament 720 is partitioned by the partition part 713 to prevent a contact of portions of the filament 720. Thus, even when external force is applied to the halogen lamp 700, a contact of the filament 720 is more effectively prevented, thereby preventing a short circuit of the filament 720 and enhancing the operation reliability of a product.

Hereinafter, a halogen lamp according to an eighth embodiment will now be described with reference to the accompanying drawing.

Figure 12:
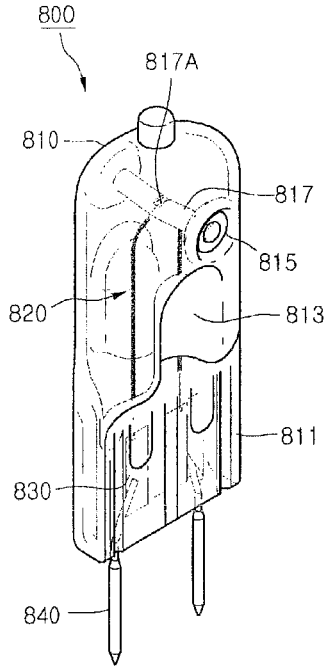
FIG. 12 is a perspective view illustrating a halogen lamp according to an eighth embodiment.

FIG. 12 is a perspective view illustrating a halogen lamp according to the eighth embodiment. In the current embodiment, descriptions of the same components as those of the seventh embodiment will be omitted.

Referring to FIG. 12, in a halogen lamp 800 according to the eighth embodiment, an end of a bulb 810 is provided with a sealing part 811, and the bulb 810 is provided with a partition part 813. The sealing part 811 and the partition part 813 are the same as those of the seventh embodiment.

A pair of through holes 815 are disposed in the outer surface of the bulb 810 at regions facing each other. The through holes 815 are disposed such that an imaginary line connecting the through holes 815 does not overlap the partition part 813.

A support part 817 passes through the through holes 815. Thus, the support part 817 is disposed in the inner space of the bulb 810 such that the support part 817 is spaced a predetermined distance from the partition part 813. A support recess 817A is disposed in the middle part of the support part 817.

A filament 820 is disposed in the bulb 810. When the filament 820 is hung on the support part 817, and particularly, when the middle part of the filament 820 is placed in the support recess 817A, both ends of the filament 820 are fixed to the sealing part 811.

In the current embodiment, both ends of the filament 820 fixed to the sealing part 811 are disposed on the same imaginary plane. The support part 817 is perpendicular to the imaginary plane on which both ends of the filament 820 are disposed.

Thus, in the current embodiment, the partition part 813 prevents a contact of portions of the filament 820, as described in the previous embodiment. In addition, in the current embodiment, since the filament 820 is supported by the support part 817, the movement of the filament 820 due to external force is minimized, thereby preventing a short circuit due to a contact of the filament 820.

Other components according to the second embodiment, that is, metal fragments 830 and lead rods 840 are the same as those of the seventh embodiment. According to the embodiments, when the filament is hung on the support part, both ends of the filament are fixed to the sealing part of the bulb. Thus, a short circuit of the filament is minimized, specifically, even when external force is applied to the halogen lamp, thereby enhancing the operation reliability of a product.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

INDUSTRIAL APPLICABILITY

Effects of the halogen lamp according to the embodiments are as follows. The filament is hung on the support part and both ends of the filament are fixed to a sealing part of the bulb, so as to Long term operating reliability is increased.

The invention claimed is:

1. A lamp, comprising:

a bulb having an enclosed space with a sealed base at a bottom of the bulb with connectors provided thereon for connection to an external power source;

a support bar that extends in a first direction a first prescribed distance across the enclosed space; and a filament having a prescribed length, wherein a portion of the filament wraps around an outer surface of the support bar, the filament comprising a first filament part and a second filament part, ends of the first and second filament parts being electrically coupled to the connectors near the bottom of the bulb, wherein the first and second filament parts are spaced apart from each other in a direction parallel to the first direction of the support bar, and the first and second filament parts are spaced apart from each other in a second direction perpendicular to the first direction, wherein the first and second filament parts define a second prescribed distance near the connectors in the first direction and a third prescribed distance near the connectors in the second direction, and wherein the second prescribed distance is less than the first prescribed distance and is larger than the third prescribed distance, and a diameter of the support bar is less than the second prescribed distance and is larger than the third prescribed distance.

2. The lamp according to claim 1, wherein the support bar is formed of the same material as that of the bulb.

3. The lamp according to claim 1, wherein the support bar comprises a recess on which the portion of the filament is wrapped.

4. The lamp according to claim 1, wherein the portion is a middle portion of the filament and disposed between the first and second filament parts.

5. The lamp according to claim 1, wherein the support bar has a V shape.

6. The lamp according to claim 5, wherein the V shape includes a notch provided at a middle of the V shape to receive the portion of the filament.

7. The lamp according to claim 1, wherein the first and second filament parts further define a fourth prescribed distance near the support bar in the first direction and a fifth prescribed distance near the support bar in the second direction, and wherein the second prescribed distance is larger than the fourth prescribed distance, and the fifth prescribed distance is larger than the third prescribed distance.

8. A lamp, comprising:

a bulb having an enclosed space with a sealed base at a bottom of the bulb with connectors provided thereon for connection to an external power source;

a support bar that extends in a first prescribed distance across the enclosed space in a first direction;

a filament having a prescribed length, wherein a portion of the filament wraps around an outer surface of the support bar, the filament comprising a first filament part and a second filament part, ends of the first and second filament parts being electrically coupled to the connectors near the bottom of the bulb; and a space bar provided between the support bar and the ends of the first and second filament parts, wherein the space bar extends in a second direction perpendicular to the first direction, wherein the space bar prevents the first and second filament parts from contacting each other, wherein the first and second filament parts are spaced apart from each other in a direction parallel to the first direction of the support bar, and the first and second filament parts are spaced apart from each other in the second direction, wherein the first and second filament parts define a second prescribed distance near the connectors in the first direction, and a third prescribed distance near the connectors in the second direction, and wherein the second prescribed distance is less than the first prescribed distance and is larger than the third prescribed distance, and a diameter of the support bar is less than the second prescribed distance and is larger than the third prescribed distance.

9. The lamp according to claim 8, wherein at least one of the support bar or the space bar is formed of the same material as that of the bulb.

10. The lamp according to claim 8, wherein the support bar has a V shape.

11. The lamp according to claim 10, wherein the V shape includes a notch provided at a middle of the V shape to receive the portion of the filament.

12. The lamp according to claim 8, wherein the first and second filament parts further define a fourth prescribed distance near the support bar in the first direction and a fifth prescribed distance near the support bar in the second direction, and wherein the second prescribed distance is larger than the fourth prescribed distance, and the fifth prescribed distance is larger than the third prescribed distance.

13. A lamp, comprising:

a bulb having an outer surface to define an inner space with a sealed base at a bottom of the bulb;

two leads provided at the bottom of the bulb and having portions exposed for connection to an external power source, the portions being spaced from each other by a first prescribed distance;

a support bar having a prescribed length such that the support bar extends in as first direction across the inner space of the bulb from a portion of the outer surface of the bulb to an opposite portion of the outer surface of the bulb, wherein the first prescribed distance of the two leads is less than the prescribed length of the support bar; and a filament having a portion wrapped around an outer surface of the support bar, wherein the filament comprises a first filament part and a second filament part, wherein ends of the first and second filament parts are electrically coupled to the two leads, wherein the first and second filament parts are spaced apart from each other in a direction parallel to the first direction of the support bar, and the first and second filament parts are spaced apart from each other in a second direction perpendicular to the first direction, wherein the first and second filament parts define a second prescribed distance near the two leads in the first direction, a third prescribed distance near the two leads in the second direction, a fourth prescribed distance near the support bar in the first direction and a fifth prescribed distance near the support bar in the second direction, and wherein the second prescribed distance is larger than the fourth prescribed distance, and the fifth prescribed distance is larger than the third prescribed distance.

14. The lamp according to claim 13, wherein the support bar has a V shape.

15. The lamp according to claim 14, wherein the V shape includes a notch provided at a middle of the V shape to receive the portion of the filament.

16. The lamp according to claim 13, wherein the first direction of the support bar is parallel to a plane which is defined by the two leads.

17. The lamp according to claim 13, wherein the first direction of the support bar crosses a plane which is defined by the two leads at a predetermined angle.

18. The lamp according to claim 13, further comprising a space bar provided between the support bar and the ends of the first and second filament parts which are electrically coupled to the two leads to prevent the filament from contacting each other among portions of the filament, the space bar having a prescribed length such that the space bar extends in a third direction across the inner space of the bulb from a portion of the outer surface of the bulb to an opposite portion of the outer surface of the bulb, the space bar being spaced from the support bar in a fourth direction which is perpendicular to the first direction of the support bar and the third direction of the space bar, wherein the first prescribed distance of the two leads is less than the prescribed length of the space bar.

19. The lamp according to claim 18, wherein the first direction of the support bar is parallel to the third direction of the space bar.

20. The lamp according to claim 18, wherein the first direction of the support bar crosses the third direction of the space bar at a predetermined angle.

* * * * *

UNITED STATES PATENT AND TRADEMARK OFFICE

CERTIFICATE OF CORRECTION

PATENT NO. : 8,796,910 B2
APPLICATION NO. : 12/920926
DATED : August 5, 2014
INVENTOR(S) : Jae kwan Jung et al.

It is certified that error appears in the above-identified patent and that said Letters Patent is hereby corrected as shown below:

On the Title Page, Item (54), and in the Specification, Column 1, line 3, Title of Invention should read:

HALOGEN LAMP COMPRISING BULB AND STRUCTURE TO PREVENT FILAMENT PARTS FROM <u>CONTACTING</u> EACH OTHER

Signed and Sealed this
Tenth Day of March, 2015

Michelle K. Lee

Michelle K. Lee
*Deputy Director of the United States Patent and Trademark Office*